US005105551A

United States Patent [19]

McCutchen et al.

[11] Patent Number: 5,105,551

[45] Date of Patent: Apr. 21, 1992

[54] BUFFERED INKING TEMPLATE

[76] Inventors: Wilmot R. McCutchen, 9 Sally Ann Rd., Orinda, Calif. 94563; Wilmot H. McCutchen, P.O. Box 701129, Houston, Tex. 77270

[21] Appl. No.: 725,402

[22] Filed: Jul. 1, 1991

Related U.S. Application Data

[63] Continuation of Ser. No. 591,387, Oct. 1, 1990, abandoned.

[51] Int. Cl.[5] ..... B43L 13/20

[52] U.S. Cl. ..... 33/563; 33/489; 434/87; 101/127

[58] Field of Search ..... 33/562, 566, 489, 492; 434/85, 87; 101/127

[56] References Cited

U.S. PATENT DOCUMENTS

| | | | |
|---|---|---|---|
| 1,029,225 | 6/1912 | Rigaumont | 33/492 |
| 1,213,813 | 1/1917 | Anderson | 33/489 |
| 1,343,968 | 6/1920 | Hahn | 33/489 |
| 2,233,481 | 3/1941 | Kuehl | 33/492 |
| 2,303,676 | 12/1942 | Bixby | 33/563 |
| 2,835,987 | 5/1958 | Heiser | 33/563 |
| 3,805,395 | 4/1874 | Hopkinson | 33/464 |
| 3,893,243 | 7/1975 | Schuller | 33/564 |
| 4,026,030 | 5/1977 | Kuever et al. | 33/565 |
| 4,349,966 | 9/1982 | Marino et al. | 33/489 |
| 4,388,764 | 6/1983 | Hermes | 33/564 |
| 4,589,210 | 5/1985 | Konrad | 33/562 |
| 4,688,330 | 8/1987 | Konrad | 33/564 |

*Primary Examiner*—William A. Cuchlinski, Jr.
*Assistant Examiner*—Christopher W. Fulton

[57] ABSTRACT

A template buffer element with cutouts which are larger than the interior cutouts of a template, attached to the template so that ink deposited on the drawing surface is separated from the working edge of the template by the buffer element, and the cutout edges of the buffer element are separated from the place of ink deposition by the difference between the dimensions of the buffer cutouts and the template cutouts. The buffer element may be a sheet of plastic or may be an array of strips made of elastomeric or nappy material which trap an air cushion under the template so as to facilitate template movement over the drawing and provide anchorage of the template to the drawing surface when the draftsperson presses down.

7 Claims, 2 Drawing Sheets

BUFFERED INKING TEMPLATE

This application is a continuation of Ser. No. 07/591,387, filed Oct. 1, 1990, now abandoned.

BACKGROUND—FIELD OF THE INVENTION

This invention relates to templates, guides, and other instruments for drawing with ink on a planar surface.

BACKGROUND—PRIOR ART

The working edge of a guide or template controls the deposition of ink on a drawing surface by engaging the side of a ruling pen operated manually by a draftsperson. Unless the draftsperson is very skilled and experienced, there is always a danger that the ink will blot or smear by going underneath the template, either spreading by capillary action over the drawing surface or by spilling out a the nib of the pen. Also, if the ink is still wet after a line is ruled and the template is accidentally jarred, the ink smears and the drawing is ruined.

The slick material used to manufacture templates tends to slip inadvertently over the drawing surface Even if capillary action alone is insufficient to cause contact of the template with the ink as the draftsperson draws, the downward pressure of the draftsperson's hand and the slick underside of the template sometimes brings the template to the ink. Template slippage also makes the template less accurate in accomplishing the draftsperson's intention.

Some guides, such as straightedges, French curves, and triangles, are manufactured with chamferred, bevelled, or channelled working edges which separate the guide from the ink being deposited on the drawing surface. However, the manufacture of such edges in a guide such as a template having a multitude of figures presents a difficult technological problem. Moreover, unless the template is made thicker than normal, such bevelled working edges must be thin and therefore fragile and inaccurate.

Thick spacers, either cast in or engaging its perimeter, are known to be effective in raising the template away from the drawing surface, thereby reducing smearing. However, such spacers raise the template too far from the drawing surface. Preferably, as is known from prior art, an inking template should be close to the drawing surface for maximum accuracy. Moreover, large, thin templates cannot be supported by spacers along their perimeter because the thin template material bends and comes in contact with the drawing surface.

Perimeter spacers and template holders are not feasible for the large and thin templates used for inking circles, ellipses, waveforms, component symbols, small machine parts, and architectural symbols. For these, draftspersons must resort to the time-consuming and cumbersome means of adding drafting tape or shims under the template in order to raise the template a small distance away from the drawing surface.

Template slippage over the drawing surface is reduced by adding low-adhesive drafting tape to the underside of the template, but this crude expedient is time-consuming and it impairs the vision of the draftsperson.

OBJECTS AND ADVANTAGES OF THE PRESENT INVENTION

The present invention separates the working edges of a guide or template from a drawing surface by means of a integrated buffer element between the template and the drawing surface. This buffer may be a sheet of material or a set of parallel strips.

By this means, even if the template should slip toward a newly-drawn line, or if the ink should tend to spread under the ruling edge of the template, no wet ink can contact the template. Therefore ink will not blot and smear and spoil the drawing when the template is moved, and a draftsperson of ordinary skill can preserve a presentable drawing.

Being integrated with the template, the buffer element need not be positioned independently of the template, as is the case with shims. Nor need the buffer be specially applied to the template as needed, with waste of time and visibility, as is the case with tape.

The working edges of the buffered template described in the present invention are as thick as in prior art. Indeed, they are exactly the same templates which are presently commercially available.

The buffer element is thin enough to permit accurate positioning of the template, and will not reduce the accuracy. In fact, the registration reference provided by opaque parallel strips on the underside of the template would said in positioning the template accurately. Existing thin guides and templates may easily be retrofitted with the present invention at little cost. Because templates, unlike triangles and French curves, are one-sided guides, the addition of a buffer on one side does not impair the template's function

DETAILED DESCRIPTION OF THE PREFERRED EMBODIMENT

Figure 1:
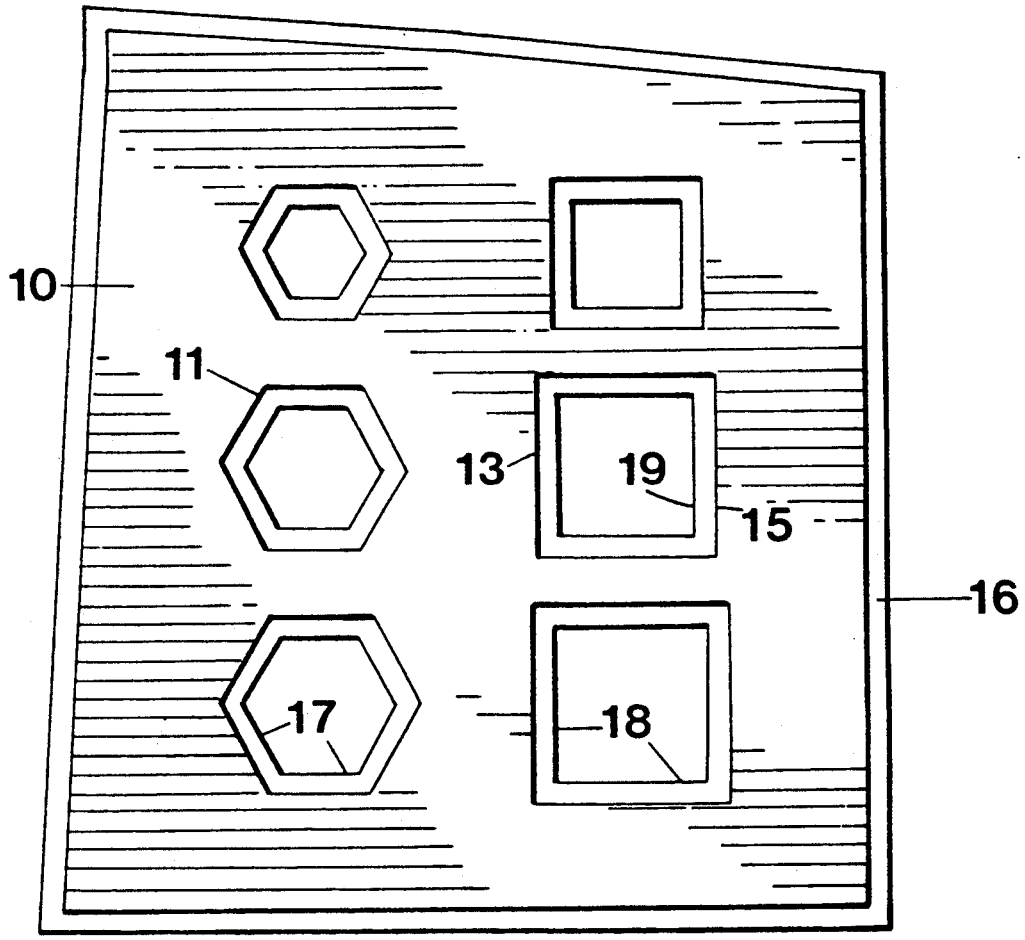

FIG. 1 shows a view of the underside of a template fitted with a planar buffer This particular template is for outlining nuts, bolt heads, and thread pitches. The template (16) is a sheet of plastic approximately 0.75 mm in thickness, which comprises cutouts (17, 18). The planar buffer element (10) is a sheet of plastic approximately 0.4 mm in thickness, having corresponding buffer cutouts (11, 13) of the same shape as the template cutouts (17, 18). The template cutouts (17, 18) are smaller by not less than approximately 2 mm in all dimensions than the corresponding buffer cutouts (11, 13). The outside edges of the buffer sheet (10) are also set back from the outside edge of the template (16) by the same distance.

The buffer sheet (10) is permanently attached to the template (16) such that the template cutouts (17, 18) are aligned with their corresponding buffer cutouts (11, 13). Approximately 2 mm in the plane of the template separates the working edge (19) of the template from the corresponding buffer cutout edge (15).

Figure 2:
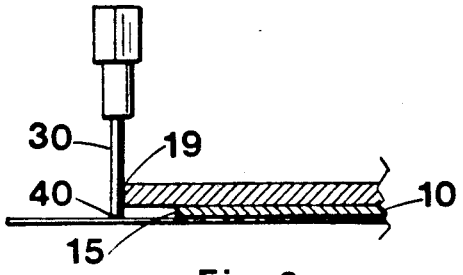

FIG. 2 shows a cross-section of the buffered template with a ruling pen (30) which engages with the template cutout edge (19) to deposit ink at a point on a drawing surface (40). The ink at (40) is separated from the template cutout edge (19) by the buffer (10) a vertical distance of approximately 0.4 mm. The corresponding buffer cutout edge (15) is set back approximately 2 mm from the template cutout edge (19).

Figure 3:
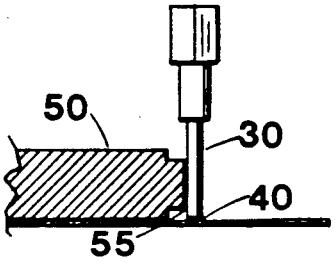
Fig. 3 Prior Art

FIG. 3 shows a cross-section of a guide such as T-squares, triangles, and French curves known from prior art. No template known to prior art has such a configuration, however. The working edge (55) of the guide (50), engages a pen (30), which deposits ink on a drawing surface (40). The working edge (55) is spaced away from the drawing surface (40) approximately 0.38 mm vertically and 0.38 mm horizontally by means of a step-like construction of the working edge (55). The thickness of the guide (50) is approximately 2.4 mm, and the thickness of its working edge is approximately 1.64 mm.

Figure 4:
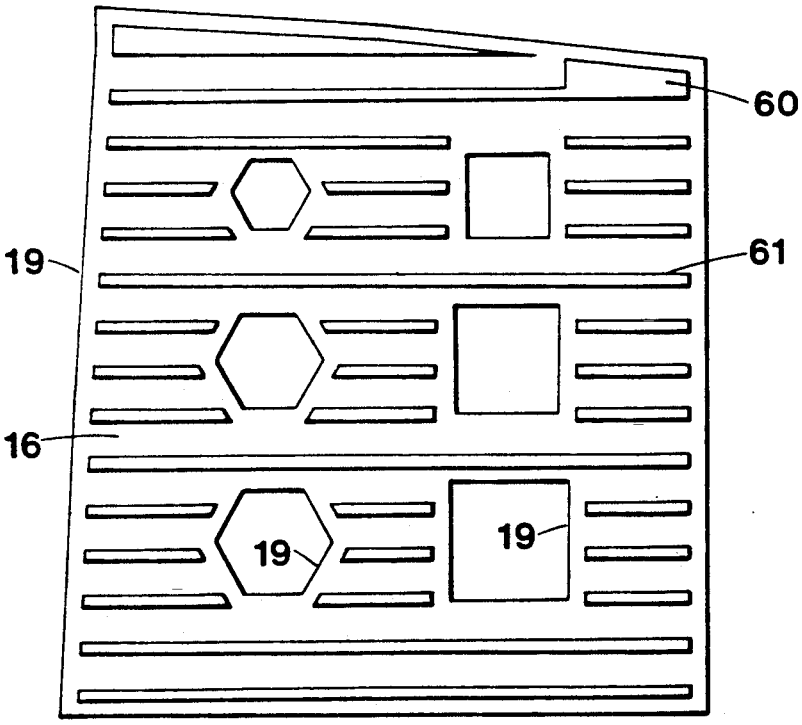
Figure 5:
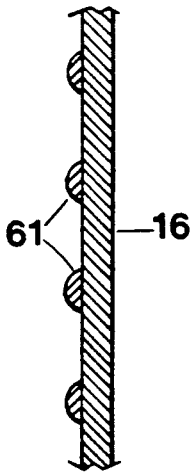

FIG. 4 shows an underside view of a template with buffer strips instead of a continuous sheet as in FIGS. 1, 2, and 3. Small strips (60, 61), each approximately 0.4 mm thick and approximately 1 mm wide, are permanently attached to a template (16). The strips parallel each other and are spaced approximately 6 mm from each other. No strip portion is closer than approximately 2 mm in the plane of the template from the working edge (19) of the template (16). These strips may be of rubber, of plastic, or of nappy material. In cross-section, the strips are semicircular.

FIG. is a cross-section of the alternative embodiment shown in FIG. 4, showing semi-circular strip buffer elements (61) on the template (16).

OPERATION, RAMIFICATIONS, AND SCOPE

The planar template or guide buffer described in the present invention will be easy to manufacture and to retrofit to existing guides or templates. It is the same guide or template, made from a thinner sheet and having larger cutouts. For example, the radius of a template circle would be approximately 2 mm smaller than the radius of the corresponding buffer cutout.

If parallel strips are used instead of a buffer sheet, the strips provide registration references for alignment of the template The space between the strips traps an air cushion for easier template movement over the drawing surface Rubber strip buffer elements, made of the same material used for the manufacture of erasers, will firmly anchor the template by friction when downward pressure is applied by the draftsperson. When this downward pressure is released, the template will be easy to move over the drawing surface because of the air cushion trapped between the strips. The same operational advantages are added by buffer strips made of nappy material With a semi-circular cross-section, the rubber or nappy strip buffer elements are easiest to move across the drawing surface and most efficient in anchoring the template.

If these strips are made of material which does not grip the drawing surface, unlike rubber or nappy material, the arrangement of these strips would nevertheless form a rib-like configuration on the underside of the template, which configuration would tend to prevent inadvertent template movement.

Adding a weak adhesive to the surface of either the planar or strip buffer elements would reduce the tendency of slick plastic templates to slip as the draftsperson holds them in place.

Both the planar and strip buffer cutouts maintain a certain definite distance between the buffer element and the working edge of the template. This distance prevents ink from contacting any part of the template even if the template slips slightly. The template with buffer as described herein can be guided easily along a T-square or triangle guide.

The foregoing description of preferred embodiments of the present invention is not in limitation of the claims asserted herein.

We claim:

1. A combination including a drafting template having a plurality of interior cutouts defining figure patterns and forming working edges for guiding a pen drawing with ink upon a drawing surface and said drafting template having outside edges and two parallel faces less than 1 mm apart, wherein the under face is the nearer face to the drawing surface when the drafting template is properly positioned for drawing upon said drawing surface and wherein the upper face has inscribed captions and registration guides for said figure patterns, and further including a planar buffer element for separating the template from the drawing surface, said planar buffer element comprising:

(a) a sheet of plastic material having a uniform thickness approximately one-half of the thickness of said drafting template, having a shape similar to the template, having outside linear dimensions each slightly less than the corresponding outside edge linear dimension of the drafting template, and having two faces, wherein the upper face is positioned in said combination adjacent to the under face of the template and the under face of said sheet of plastic material is positioned in said combination to rest upon the drawing surface;

(b) a plurality of interior cutouts in said sheet of plastic material, wherein each of said interior cutouts has a correspondence in shape and location with one of the interior cutouts of the drafting template and has a dimension uniformly slightly larger than the corresponding interior cutout of the drafting template; and (c) adhesive means to attach securely and permanently said upper face of said sheet of plastic material in proper corresponding position on the under face of the drafting template, whereby said working edges of the interior cutouts of the drafting template are spaced away from any part of said sheet of plastic material.

2. The combination of claim 1 wherein said planar buffer element further comprises weak adhesive means for producing a tack surface on said under face of said sheet of plastic material, whereby the combination is constrained momentarily from slipping over the drafting surface upon application of pressure by a draftsperson of the drafting template during the process of drafting with the drafting pen and whereby the combination is free to be moved over the drafting surface upon release of pressure on the template.

3. A drafting instrument for guiding a pen in drawing smear free ink figures on a drawing surface, said drafting instrument including a template having a plurality of interior cutouts, having outside edges, and having two parallel faces, wherein the under face is nearer the drawing surface when the template is positioned for drawing upon said drawing surface and the upper face has inscribed captions and guides for said figures, and further including a buffer assembly for vertically offsetting said template from the drawing surface during ink deposition to prevent ink smearing and for assisting in control of movement of said template during and after ink deposition, said buffer assembly comprising:

(a) a plurality of strips of resilient and opaque material, each of said strips having an approximately semi-circular cross-section with a radius approximately one-half the thickness of the template; and (b) adhesive means to attach securely and permanently the planar portion of each of said strips to those areas of the under face of said template that are slightly away from any of the outside edges and any edge of the interior cutouts of the template, whereby said strips form an array offsetting the template from the drawing surface when said drafting instrument is positioned for drawing on said drawing surface.

4. The drafting instrument of claim 3 wherein said strips are made of elastomeric material.

5. The drafting instrument of claim 3 wherein said strips are made of natural rubber composition.

6. The drafting instrument of claim 3 wherein said strips are made of nappy material.

7. The drafting instrument of claim 3 wherein said strips are coated on their circular surfaces with tacky adhesive means to inhibit accidental slippage of said drafting instrument when placed over the drafting surface wheel at the same time allowing purposeful movement of said drafting instrument over the drafting surface.

* * * * *